US007392652B2

(12) United States Patent
Heath

(10) Patent No.: US 7,392,652 B2
(45) Date of Patent: Jul. 1, 2008

(54) SYSTEM AND METHOD FOR DIESEL PARTICULATE TRAP REGENERATION IN A MOTOR VEHICLE WITH AN AUXILIARY POWER UNIT

(75) Inventor: Stephen P. Heath, Fort Wayne, IN (US)

(73) Assignee: International Truck Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/051,930

(22) Filed: Feb. 4, 2005

(65) Prior Publication Data

US 2006/0174609 A1 Aug. 10, 2006

(51) Int. Cl.
*F01N 3/00* (2006.01)
*F01N 3/10* (2006.01)
*F01N 21/04* (2006.01)

(52) U.S. Cl. ..... 60/297; 60/295; 60/311; 60/698

(58) Field of Classification Search ..... 60/295, 60/297, 311, 698
See application file for complete search history.

(56) References Cited

U.S. PATENT DOCUMENTS 4,448,157 A 5/1984 Eckstein et al.
4,611,466 A 9/1986 Keedy
4,677,823 A 7/1987 Hardy
4,682,649 A 7/1987 Greer
4,756,359 A * 7/1988 Greer ..... 165/43
4,762,170 A 8/1988 Nijar et al.
4,825,663 A 5/1989 Nijar et al.
RE33,687 E 9/1991 Greer
5,050,376 A 9/1991 Stiglic et al.
5,333,678 A 8/1994 Mellum et al.
5,456,240 A * 10/1995 Kanesaka ..... 123/565
5,528,901 A * 6/1996 Willis ..... 60/626
5,964,088 A * 10/1999 Kinugasa et al. ..... 60/286
6,145,303 A 11/2000 Strehlau et al.
6,594,990 B2 * 7/2003 Kuenstler et al. ..... 60/295
6,832,473 B2 * 12/2004 Kupe et al. ..... 60/286
2004/0035112 A1 2/2004 Bhabra
2004/0144080 A1 * 7/2004 Suzuki et al. ..... 60/276

* cited by examiner

*Primary Examiner*—Thomas Denion
*Assistant Examiner*—Loren Edwards
(74) *Attorney, Agent, or Firm*—Jeffrey P. Calfa

(57) ABSTRACT

Diesel engine particulate trap regeneration is obtained by concurrently supplying two exhaust gas streams to a particulate trap requiring regeneration. One stream is produced in a reactor/diesel engine operating an efficient stoichiometric ratio. The second stream is produced in a second reactor/diesel engine burning fuel at a low air/fuel ratio to produce an exhaust gas stream carrying a substantial load of unburned hydrocarbons, hydrogen and carbon monoxide. The two streams together carry sufficient thermal energy to ignite the unburned hydrocarbons, hydrogen and carbon monoxide using oxygen from the first exhaust gas stream as oxidizer.

3 Claims, 2 Drawing Sheets

SYSTEM AND METHOD FOR DIESEL PARTICULATE TRAP REGENERATION IN A MOTOR VEHICLE WITH AN AUXILIARY POWER UNIT

BACKGROUND OF THE INVENTION

1. Technical Field

The invention relates to regeneration of diesel exhaust particulate traps and more particularly, to a system and method for introducing heat, fuel and oxidizer to the particulate trap to induce combustion of particulate buildup.

2. Description of the Problem

Diesel engines generate unburned hydrocarbons (HC), carbon monoxide (CO), carbon dioxide ($CO_2$), nitrogen oxides ($NO_x$), and particulates, and can pass molecular oxygen ($O_2$) with the exhaust product. The particulate matter is principally solid particles of carbon and metal compounds with adsorbed hydrocarbons, sulfates and aqueous species. Among the adsorbed species are aldehydes (e.g. formaldehyde) and polycyclic aromatic hydrocarbons. Particulates, and carbon monoxide, are principally byproducts of incomplete combustion. Combustion in the engine can be modified to minimize particulate generation, however, doing so with contemporary technology leads to increases $NO_x$ emission.

Nitrogen oxides are also considered undesirable. NO is produced in large quantities at the high combustion temperatures which promote complete combustion and avoid particulate generation. $NO_2$ is formed principally by the post oxidation of NO in the exhaust. $NO_2$ production can be reduced by retarding engine timing and exhaust gas recirculation, both of which again contribute to particulate generation. Low emissions of nitrogen oxides also favor generation of CO and leave unburned hydrocarbons.

A currently favored approach to lowering diesel emissions is to accept increased particulate levels in the exhaust stream from the engine in order to reach the $NO_x$ targets, and to introduce a particulate trap to the exhaust stack to then remove the particulates and achieve the desired emission levels. Such traps can be constructed of metal or ceramics, and include a filter capable of collecting particulates from the exhaust stream. The trap must be able to withstand high temperatures, which are introduced to the traps periodically to oxidize particulate deposits which form in the traps. It has not proven easy to maintain traps at a sufficient temperature to burn the carbon deposits, especially where the traps are located a substantial distance from the engine compartment and downstream from exhaust energy recovery devices, such as power turbines for turbocharging systems. The problem is further complicated when the diesel is operating under a partial load. Secondary measures such as electrically powered heaters, which consume a great deal of power, have been built into particulate traps to address this problem. Particulate oxidation is further promoted by the injection of fuel into the exhaust stream which burns on contact with the heaters. This method of course increases fuel usage.

As part of tighter motor vehicle emission standards, commercial operators will be required to avoid long term idling of diesel engines. Extended idling has been a common practice for drivers who park their rigs for mandatory break periods and desire to have power for heating, cooling and entertainment while on break.

SUMMARY OF THE INVENTION

According to the invention there is provided a particulate trap regeneration system for a diesel engine exhaust treatment system. A second hydrocarbon reactor, preferably a second diesel engine, is connected to discharge into the same particulate trap as the primary reactor. The second diesel engine is usually much smaller than the primary engine, and is used to run an auxiliary power plant to eliminate the need to operate the primary diesel to supply electrical power to the vehicle when the vehicle is standing. Normally, the second diesel engine is operated at a stoichiometric air/fuel ratio to achieve full combustion. However, under circumstances where the particulate trap is indicated as fully loaded, the second diesel may be operated concurrently with the first diesel to promote combustion in the particulate trap and thereby regenerate the trap. Under these conditions, the second diesel Is operated at an insufficient air/fuel ratio to support complete combustion, producing a high concentration of unburnt hydrocarbons and free hydrogen entrained in its exhaust stream. Simultaneous introduction of the two exhaust streams into the particulate trap introduces sufficient thermal energy to the trap to promote ignition in the particulate trap with the unburned hydrocarbons and hydrogen from the second exhaust stream supplying the fuel and the first exhaust stream supplying the oxidizer.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawing, wherein:

DETAILED DESCRIPTION OF THE INVENTION

Figure 1:
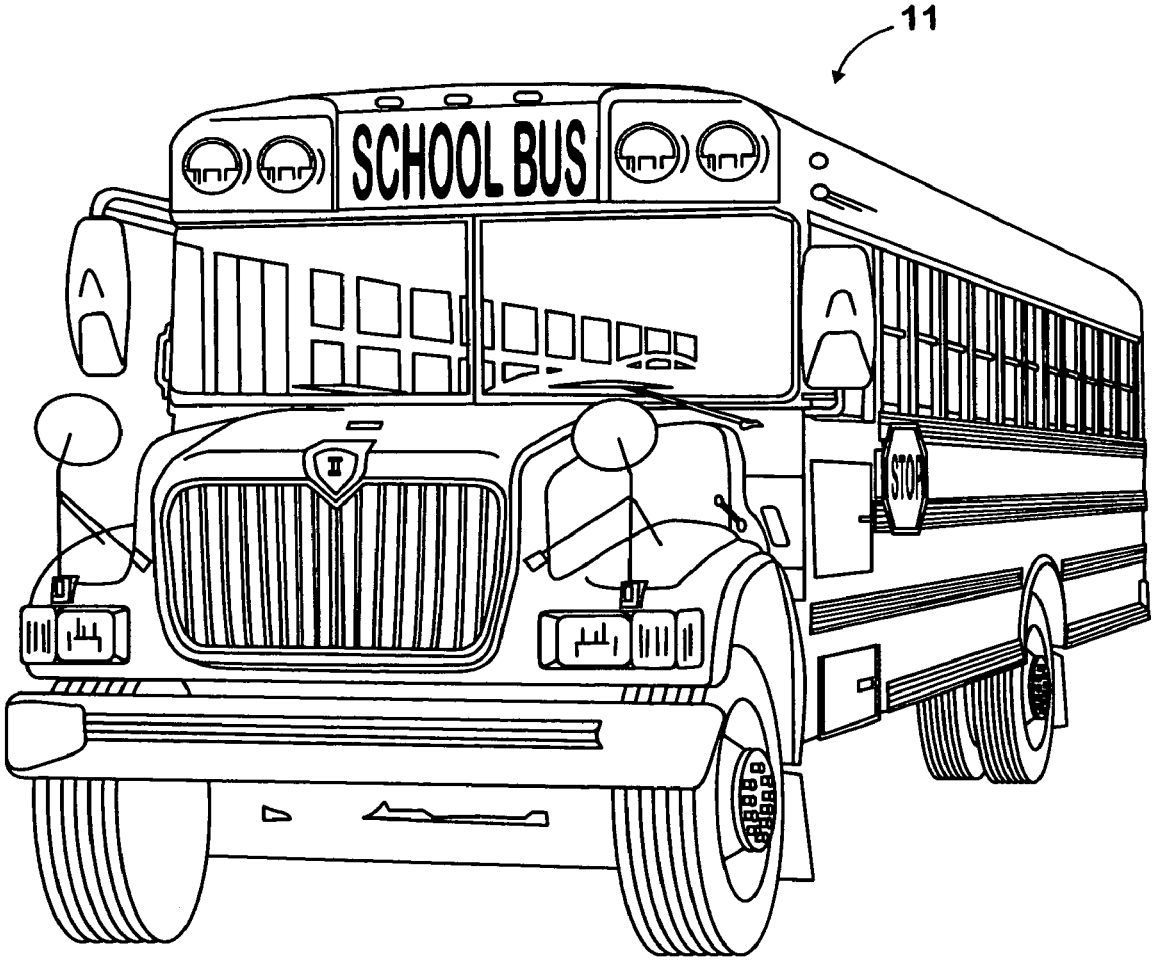
FIG. 1 is a perspective view of a motor vehicle to which the present invention might advantageously be applied.

Referring to the figures and in particular to FIG. 1, a motor vehicle 11 as may be equipped with a diesel engine is illustrated. Such vehicles are, at the time of the writing of this application, being subjected to increasingly strict emission limits relating to nitrogen oxides and particulates.

Figure 2:
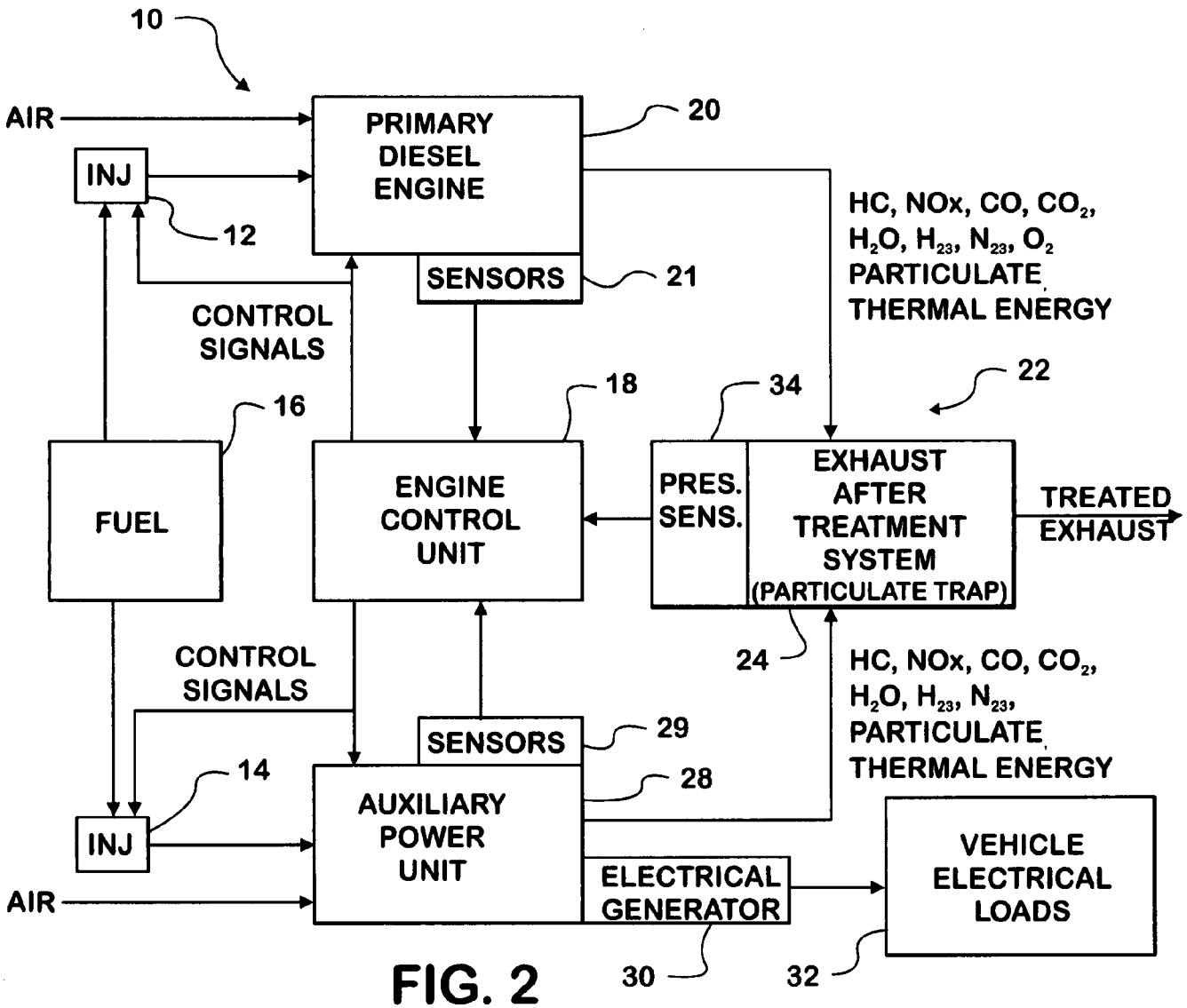
FIG. 2 is a schematic of an overall configuration of the system.

Referring to FIG. 2, a high level schematic of a motor vehicle power plant and exhaust treatment system 10 generally illustrates the environment of the invention. As is conventional, air is drawn from the environment and introduced or pumped into engine 20, an auxiliary power unit (APU) 28, or both. APU 28 is preferably a one or two cylinder diesel engine of small displacement which can operate on the same diesel fuel used for the primary diesel engine 20. However, APU 28 can be any engine which can be run "rich", that is, to generate exhaust carrying a high concentration of unburned hydrocarbons (HC) and to generate substantial thermal energy. Even a coal or wood burning stove could function in this role. Where APU 28 is a diesel, fuel for its operation is drawn from a fuel reservoir 16 which also supplied primary diesel 20. Fuel is injected by fuel injectors 12 and 14 into the cylinders of engine 20 and APU 28 for operation of the engines. The air/fuel ratio is controlled by controlling the amount of fuel injected into the cylinders. This control is implemented through control signals from an engine control unit 18. While APU 28 can be operated independently to turn an electrical generator 30 to power vehicle electrical loads 32, the system and method of the present invention contemplates that APU 28 and primary diesel engine 20 will be run concurrently to effect regeneration of the particulate trap of exhaust after treatment system 24.

Exhaust gases from the primary diesel engine 20 are discharged into the exhaust system generally indicated by the numeral 22. Within the exhaust system is an exhaust after treatment system 24 comprising a particulate trap of conventional design. The particulate trap is essentially a filter constructed from a very high temperature resistant material. The filter catches and holds particulate matter entrained within the exhaust gases discharged into the exhaust system 22. The particulate trap must periodically be regenerated to limit increases in exhaust system 22 back pressure and thereby maintain engine efficiency. According to the present invention, the particulate trap is regenerated by periodically by introducing a supplementary exhaust stream into the particulate trap from an auxiliary power unit 28 which provides fuel for initiating burnoff of the particulates. The particulates caught in the particulate trap are then combusted to reduce the particulate material to gas and ash. The ash falls into a trap for periodic removal at appropriate maintenance intervals. Combustion in the particulate trap depends upon delivery of sufficient oxygen to the particulate trap and increasing the temperature to support combustion. Supplying additional fuel, beyond the fuel value of the particulates themselves, if any, initiates and supports the combustion process. In the present invention oxygen is supplied in the exhaust stream from the primary diesel engine 20, which runs lean, that is a close stoichiometric balance. Supplemental fuel is supplied by the auxiliary power unit 28 in the form of uncombusted HC resulting from running the APU rich, that is with too much fuel for the amount air being drawn from the environment. Sufficient heat to initiate combustion in the particulate trap is supplied by the combination of the exhaust streams from the auxiliary power unit and primary diesel engine entering the particulate trap concurrently.

Primary diesel engine 20 and APU 28 qualitatively produce (or pass) the same constituents in their respective exhaust streams. Generally these constituents are HC, nitrogen oxides, carbon monoxide, carbon dioxide, water, hydrogen, nitrogen, oxygen, particulates and thermal energy. Engine control provided by the engine control unit, operating on data returned by engine sensor packages 21, 29 allows the relative quantities of the physical constituents and the amount of heat released to be adjusted. In particular, APU 28 operates as a reactor which generates a surplus of CO and unburned hydrocarbons when regeneration is occurring. When APU 28 is used alone it is operated at an efficient stoichiometric balance. Only when APU 28 operates in parallel to primary diesel engine 20 is its mixture set rich. This can occur when the vehicle is in motion, under power by primary diesel engine 20, and an increasing pressure drop is detected by differential pressure sensor 34 across the exhaust after treatment system, indicating a build up of particulate material in the particulate trap and the need to regenerate the trap. APU 28 is then operated non-stoichiometrically to effect conditions in the particulate trap conducive to its regeneration. When APU 28 is operated in parallel to primary diesel engine 20 it increases the amount of electrical power available onboard a vehicle. APU 28 may also be used as the primary electrical power source on the vehicle to operate functions such as power steering, etc.

By controlling and locating the exhaust after treatment system 24 and APU 28 away from the main engine compartment and out from a vehicle cab, thermal elevation under the cab is minimized. APU 28 is located close enough to exhaust after treatment 24 that its exhaust, combined with the thermal energy from the primary diesel engine 20, can initiate combustion in the particulate trap portion. Conventional fuel dosing of the diesel emissions from the primary diesel engine 20 or fuel injector 12 is no longer needed. Combustion ratios are advantageously developed for use under various conditions, e.g., when the primary diesel 20 is at idle.

The invention allows the fuel used for particulate trap regeneration to be burned in a controlled reaction, and thus allow use to be made of the fuel, rather than dumping the fuel into the exhaust stream and wasted. Fuel is saved. The APU emits controlled non-stoichiometric combustion by product as fuel for regeneration of a particulate trap, but can be returned to stoichiometric operation to meet emission regulations.

While the invention is shown in only one of its forms, it is not thus limited but is susceptible to various changes and modifications without departing from the spirit and scope of the invention.

What is claimed is:

1. Apparatus comprising:

a particulate trap for removing matter from exhaust streams;

a diesel engine connected to discharge a primary exhaust stream into the particulate trap;

an auxiliary diesel engine operating from a common fuel as the diesel engine connected to discharge a secondary exhaust stream into the particulate trap;

engine sensors for the diesel engine and the auxiliary diesel engine;

means for determining occasions of excess buildup of particulate matter in the particulate trap; and a controller responsive to an indication generated by the means for determining of excessive build up of matter in the particulate trap for initiating concurrent operation of the diesel engine and auxiliary diesel engine and further responsive to the engine sensors for varying inputs of fuel and air into the diesel engine and the auxiliary diesel engine during concurrent operation including setting the ratio of fuel and air in stoichiometric balance for normal engine operation for both the diesel and the auxiliary diesel engine and further including setting the fuel and air ratio for the auxiliary diesel engine out of stoichiometric balance to introduce a combustion by-product fuel and sufficient thermal energy into the secondary exhaust stream to initiate combustion in the particulate trap while concurrently keeping the relative inputs of fuel and air into the diesel engine at a ratio maintaining a sufficient quantity of oxygen in the primary exhaust stream into the particulate trap to support initiation of combustion for regeneration of the particulate trap.

2. Apparatus as claimed in claim 1, the auxiliary diesel engine being coupled to an electrical generator to function as a prime mover for the electrical generator.

3. Apparatus as claimed in claim 2, wherein the controller is an engine controller and further comprising fuel injectors for the diesel engine and the auxiliary diesel engine coupled to the engine controller for control of the amount of fuel introduced to the primary diesel engine and the auxiliary diesel engine to vary the relative constituents of the exhaust produced by the respective engines to supply a combustible mixture in the particulate trap.

* * * * *